US005517217A

United States Patent [19]

Haselby et al.

[11] Patent Number: 5,517,217

[45] Date of Patent: May 14, 1996

[54] APPARATUS FOR ENHANCING INK-FLOW RELIABILITY IN A THERMAL-INKJET PEN; METHOD FOR PRIMING AND USING SUCH A PEN

[75] Inventors: Robert D. Haselby, San Diego; Irene H. Williams, Escondido; Gerold Firl, Poway, all of Calif.

[73] Assignee: Hewlett-Packard Company, Palo Alto, Calif.

[21] Appl. No.: 968,705

[22] Filed: Oct. 30, 1992

[51] Int. Cl.[6] ..... B41J 2/165

[52] U.S. Cl. ..... 347/23; 347/35

[58] Field of Search ..... 346/1.1, 75, 140 R; 347/23, 19, 14, 6, 92, 60, 35, 7; B41J 2/125, 2/165

[56] References Cited

U.S. PATENT DOCUMENTS

| | | | |
|---|---|---|---|
| 4,323,908 | 4/1982 | Lee et al. | 347/92 X |
| 4,493,993 | 1/1985 | Kanamuller et al. | 346/140 RX |
| 4,577,203 | 3/1986 | Kawamura | 346/140 R |
| 4,590,482 | 5/1986 | Hay et al. | 346/1.1 |
| 4,692,777 | 9/1987 | Hasumi | 346/140 R |
| 4,768,045 | 8/1988 | Koto | 346/140 R |
| 4,970,534 | 11/1990 | Terasawa et al. | 346/140 R |
| 4,977,459 | 12/1990 | Ebinuma et al. | 347/23 X |
| 5,128,690 | 7/1992 | Nozawa | 346/1.1 |
| 5,289,207 | 2/1994 | Ebisawa | 347/23 |

*Primary Examiner*—Benjamin R. Fuller
*Assistant Examiner*—Alrick Bobb

[57] ABSTRACT

Signals indicating ink-discharge presence control priming and preferably halt document creation pending ink resupply—or pending an operator command to go on without resupply. A detector senses ink discharge; circuits including a programmed microprocessor apply the detector signal to control, most typically, pen priming or repriming—and preferably related functions including suspension of printer operation. The detector preferably includes an optical source and detector along an optical path that intersects an ink-discharge path. With a pen that has multiple ink-discharge nozzles, preferably the apparatus distinguishes between ink discharge from the different nozzles (by correlation with nozzle-actuating pulses), and accordingly controls priming of each nozzle independently. Preferably this system is operated before starting to print a new sheet and upon newly installing a pen. In event of inadequate ink discharge, progressively more-energetic priming impulses (higher voltage or duration, or both) are directed to the pen, until adequate discharge results or no further energy increase is deemed suitable.

12 Claims, 7 Drawing Sheets

+5V
R15
U2
27
26
C8
R13
29
R7
R8
25
15
DROP
NDROP
RESET
41
41
42
S
C
D
D
R
16
R6
C6
U1C
LM324
14
R5
+12V
R10
R11
C7
13
C4
R4
U1B
R3
+12V
S1
R14
28
11
22
C3
12
24
R9
C1
R1
U1A
22
R2
21
C2
21
CR1
8
9
C5
U1D
7
23
Q1
R12
+12V
7'
DS1
1

83
Look for 8 consecutive drops from 4000 fires
Found 8 consecutive drops ?
Yes
Last nozzle ?
No
Next nozzle
Yes
Pen passes nozzle verification
84
No
Second time thru ?
No
Wipe pen 2 times
Yes
Perform nozzle ramp (+)
88
No
86
85
Is nozzle recovered by nozzle ramp ?
Yes
Is this the 3rd nozzle recovered by nozzle ramp ?
No
87
Yes
Reject pen
89

APPARATUS FOR ENHANCING INK-FLOW RELIABILITY IN A THERMAL-INKJET PEN; METHOD FOR PRIMING AND USING SUCH A PEN

BACKGROUND

1. Field of the Invention

This invention relates generally to thermal-inkjet (TIJ) pens in a printing machine; and more particularly to a system for sensing ink discharge to control pen-priming or document creation (or both) using such a printer.

2. Prior Art

TIJ pens sometimes are subject to nozzle failure. Such failure can be particularly problematical when it affects only a few of the nozzles in a pen, because operators of a printer do not generally think about inspecting for proper operation of every nozzle.

In general, failure of one or a few nozzles will affect only certain specific kinds of imprinted features. For example, in printing of alphabetic characters, such failure may degrade perhaps only some small elements of only certain letters—such as perhaps the serif on a letter "j", or one end of the crossbar on a "t".

These features are not conspicuous when a printing-machine operator merely glances at a page of text. They may be quite unacceptable, however, to a supervisor, quality-control manager, or customer.

Even if it were to occur to an operator to check operation of every nozzle in a newly installed pen, the necessary procedure—merely for checking the nozzles—would be obscure. It would have to be learned, and would be somewhat tedious.

Then if one more nozzles turned out to be nonfunctioning, or not functioning reliably, the operator of a printer heretofore would have little alternative but to print with an at least partially inoperative pen—or discard the pen and start again with a new one. This resolution of the matter would be undesirably expensive.

It would also be very wasteful, since virtually all new pens do in fact contain ink and in principle nearly all nozzles can in fact be started and made to flow reliably by suitable techniques. In many cases the operator may succeed in getting all the nozzles to work properly simply by operating the pen for a while, but the operator would have no way to determine in advance whether this effort would eventually succeed or, if so, how much time might be required to do so.

As a result, a large document may be printed, and perhaps copied, before significant printing defects are noticed. Fortunately this is rare, but its rarity tends to make it less likely to be noticed in time to prevent wasting time, paper (or other printing-medium stock), and money.

At least one prior printing machine does include a separate station into which a pen can be inserted for manually initiated priming. This arrangement is quite useful, but does require additional knowledge, time and care on the part of the operator—to remove the pen from its normal operating position, install it in the priming station, operate the priming apparatus, move the pen back into the normal position and try again. This system also typically requires iterating the procedure to some appropriate extent—and may call for some operator sophistication to decide what that extent is.

After a pen has been primed and ink can flow from each nozzle, usually ink flows reliably unless the system is out of service for protracted periods or is subjected to unduly harsh handling. In such cases unreliable operation occasionally recurs.

Later, however, as the ink supply nears exhaustion, once again ink flow becomes uncertain; and again automatic monitoring of the electrical actuating system does not readily reveal the moment when ink actually runs out. Consequently an operator may come back to a printer that has been directed to produce a long document to discover that some or many pages are blank.

Of course this type of printing failure is much easier to detect, for just a glance at the most recently ejected sheet reveals it. An operator who happens to notice that a printer is ejecting blank pages can stop the machine to replenish the ink.

Nevertheless such observation does require significant vigilance. The operator of a printer generally has other responsibilities, which can be handled more efficiently if not interrupted for monitoring a printer.

Just inside, or part of, each nozzle of a typical TIJ pen is a tiny thin-film resistive heater—controlled by actuating signals from a microprocessor through pen-drive circuitry, and positioned to heat and vaporize a very small volume of ink. Just ahead of this vaporized volume, an ink drop is expelled from the nozzle by abrupt expansion of the vapor.

Heretofore TIJ printing machines could automatically confirm passage of the actuating signals to the pen—and even, to some extent, could confirm operation of the thin-film resistor and other actuating elements within the pen that receive those signals and discharge the ink. For example, the DeskJet® and PaintJet XL300® printers produced by Hewlett Packard Company of Palo Alto, Calif., automatically test for open circuits and TIJ-nozzle actuating resistors; however, these printers cannot determine whether the nozzles are actually working—except by printing a test pattern for human visual observation, and for human discrimination between performances of the different nozzles.

Several mechanical phenomena sometimes prevent or partially inhibit ink flow, even when the actuating system is working. These phenomena include, but are not limited to:

- exhaustion of ink,
- ink crusting,
- viscous plugs (i.e., increase in ink viscosity, generally due to exposure to air),
- open nozzle-actuating resistors,
- open or poor connectors between electronic modules,
- open or intermittent trailing cables on printers with scanning print heads, and
- malfunctioning pen-drive circuitry, U.S. Pat. No. 4,922,270—issued May 1, 1990, to Cobbs, Haselby (one of the present inventors) and Osborne—teaches use of an ink-drop detector to synchronize operation of pens in a multipen printer. That document, however, suggests no other practical use for information from such a detector.

As can now be seen, important aspects of the technology which is used in the field of the invention are amenable to useful refinement.

SUMMARY OF THE DISCLOSURE

The present invention introduces such refinement. In its preferred apparatus embodiments, the invention provides apparatus for enhancing reliability of ink flow from a thermal-inkjet pen. That apparatus operates in a printing machine used for creation of documents, substantially without regard to presence or coordination of any other pen in the same machine.

The apparatus comprises some means, responsive to discharge of ink from the pen, for generating at least one signal that is characteristic of the discharge. For purposes of generality and breadth in describing the invention, since these means may take any of a great variety of forms, I shall refer to these means as the "discharge-responsive means" or even more simply as the "responsive means".

The apparatus also comprises some means for applying the "at least one signal" to control at least one function related to priming the pen. Once again, for breadth and generality I shall call these the "signal-applying means" or the "applying means".

In its procedure embodiments, the invention is a procedure for controlling the priming and use of a thermal-inkjet pen in a printing machine used for creation of documents. The procedure comprises the steps of detecting a discharge of ink from the pen, for genera ting at least one signal that is characteristic of that discharge; and applying this at least one signal to control the priming and use of the pen.

The foregoing may be descriptions or definitions of the apparatus and procedure of the present invention in their broadest or most general terms. Even in such general or broad forms, however, as can now be seen the invention resolves the previously outlined limitations of the prior art.

In particular, the invention makes functions related to pen priming—or the priming and use of the pen—responsive to actual discharge of ink, rather than only to apparatus which produces discharge when operating properly. Therefore a much higher level of assurance of proper operation results.

The invention thus provides a very significant advance relative to the prior art. Nevertheless, for greatest enjoyment of the benefits of the invention, the invention is preferably practiced in conjunction with certain other features or characteristics which enhance its benefits.

In apparatus embodiments, for example, it is preferred that the signal-applying means comprise means for priming or repriming the pen. Preferably these means operate if the signal indicates, or if the signals indicate, inadequate discharge of ink from the pen.

It is also preferred that the discharge-responsive means comprise an optical source, an optical detector for detecting radiation from the source and for generating the at least one signal, and some means defining an optical path for passage of radiation from the source to the detector. In conjunction with these elements it is preferred that the signal-applying means further comprise some means defining an ink-discharge path that intersects the optical path—so that the detector detects less radiation in event of discharge of ink from the pen.

In addition the apparatus preferably comprises some means for applying the signal or signals to suspend document creation pending ink resupply if the signals indicate, or the signal indicates, inadequate ink discharge from such pen.

The invention has particularly great benefits when used with a pen that has multiple nozzles for ink discharge. In this case the at least one priming-related function comprises substantially independent priming of each of the nozzles; and the apparatus further comprises some means for distinguishing between ink discharge from the different nozzles of such pen, respectively.

Further, still with reference to multinozzle pens, the at least one signal comprises multiple signals, including one signal characteristic of ink discharge from each nozzle respectively; and the responsive means comprise means for applying those multiple signals to control the substantially independent priming of each nozzle respectively.

In its procedure embodiments, for example, preferably the detecting and applying steps are performed before starting creation of a new sheet of a document. Also preferably these steps are performed before beginning document creation with a newly installed pen.

I prefer that the procedure further comprise the step of directing to the pen a priming impulse of nominally suitable energy; and that the detecting step comprise, in a generally synchronized relationship with this impulse-directing step, defining the at least one signal. Through this technique, the detector signal or signals in essence are associated with a specific priming impulse, and so with a specific nozzle and a specific priming-energy level.

This association of discharge-characterizing signal with particular impulse energy then makes possible, and preferable, inclusion in the applying step of these substeps:

(1) determining whether the at least one signal indicates inadequate discharge of ink from the pen and, if so, (2) directing a more-energetic priming impulse to the pen.

The procedure then preferably further comprises repeating the detecting step, but with respect to the more-energetic priming impulse of the directing substep, denoted "(2)" above. Next, it is preferable that the procedure further comprise iterating the applying and repeating steps. These steps are iterated in alternation, as a pair, with progressively more-energetic priming impulses in the directing substep (2), until either:

the at least one signal indicates adequate discharge of ink from the pen, or a priming impulse of maximum suitable energy has been applied.

If a priming impulse of maximum suitable energy has been applied, preferably the procedure includes also suspending creation of documents pending ink resupply. In a further refinement it is preferred that document creation be suspended pending either:

ink resupply, or an operator's command to proceed despite inadequate ink discharge.

When implementing procedural embodiments that include, as mentioned above, directing priming pulses to the pen, the first directing step preferably comprises transmitting to the pen an electrical pulse of a particular voltage and duration. The directing substep (2) of the applying step then preferably comprises transmitting to the pen an electrical pulse having a higher voltage, or having longer duration, or having some combination of higher voltage and longer duration, than in the first directing step.

Most of the preferred features or characteristics of the apparatus embodiments of the invention have some applicability in the procedure embodiments, and conversely. This is true, for example, of the multiple-nozzle system in which operation of different nozzles is distinguished and the nozzles are tested and primed independently.

In the procedure aspects of this last-mentioned system the distinguishing step comprises automatically commanding a particular nozzle of the pen to discharge ink and concurrently setting an electronic memory element to receive a discharge-characteristic signal associated with said commanded discharge. The distinguishing step further comprises then reading the status of the memory element to determine what discharge-characteristic signal it receives, before setting the electronic memory to receive a discharge-characteristic signal associated with any other discharge.

All of the foregoing operational principles and advantages of the present invention will be more fully appreciated upon consideration of the following detailed description, with reference to the appended drawings, of which:

BRIEF DESCRIPTION OF THE DRAWINGS

FIG. 6 represents the pen-checking and calibrating procedure employed preliminary to beginning each plot (or page);

FIG. 7 represents details of a nozzle-verification procedure which appears as block 77 in FIG. 6; and FIG. 8 represents details of a nozzle-ramp procedure which appears as block 88 in FIG. 7.

DETAILED DESCRIPTION OF THE PREFERRED EMBODIMENT

Figure 1:
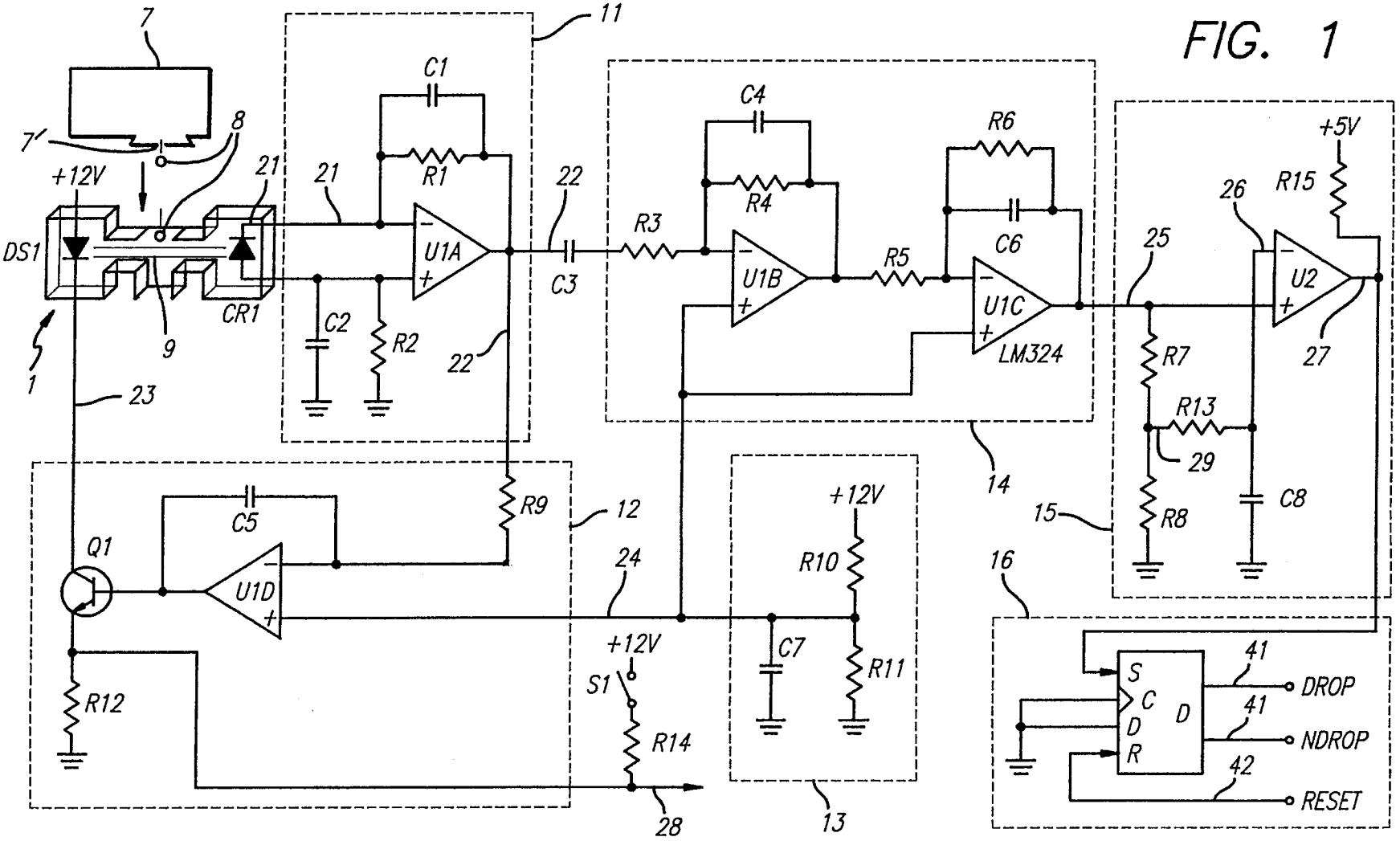
FIG. 1 is an electronics schematic showing a detection and control circuit for use in preferred embodiments of the invention.

Securing proper operation of a new (or dry) TIJ pen requires verification that each nozzle is primed—in other words, that ink flow has been started. Priming should include verification that each nozzle is free of air bubbles, as bubbles otherwise can produce not only gaps in printing but also an uncontrolled spraying effect.

In preferred embodiments of the invention, drop-sensing feedback is used to control a pen-priming or pen-repriming sequence. In such a sequence a printer tries to start or restart each nozzle by directing to its thin-film resistor a special actuating signal—here called a "priming impulse"—which is somewhat higher in voltage or in duration than the usual actuating signals.

For any nozzle that is nonresponsive, the printer tries again and again—using progressively more energetic priming impulses. The sequence continues until either the nozzle starts or a maximum permissible or otherwise suitable impulse energy has been tried.

When a nozzle does start, the pen is sent further actuating signals in a series that is long enough to substantially confirm absence of bubbles, or to exhaust such bubbles from the pen. If one or more nozzles are not started by this process, the apparatus signals the operator.

The operator may then decide either to discard the pen or proceed with the subject nozzle or nozzles not working. With this notification, the operator may examine a partial test pattern or plot to determine the visual impact of the malfunction.

The option of proceeding with a pen that is only partially operative may be preferred in situations where high writing quality is not important enough to justify the cost of a new pen. This often may be so, for instance, in making a draft or a rough record copy of a document.

These options are quite distinct from those available in the prior-art situations discussed earlier—in which the operator was the first and primary line of defense against ink-flow malfunction. Here the apparatus has not merely tested the pen but applied a progressively more rigorous regimen of priming stimuli to attempt to start or restart ink flow, before invoking—only as a last resort—the operator's decision.

Further, that decision whether to print with a partially inoperative pen or change the pen (or try to print for a while in the hope that the pen will come into fully working order) now is illuminated by knowledge that the system has already completed efforts to make the pen work better. Under these circumstances the operator can be certain that the pen is very unlikely to improve with further operation.

One factor limiting the above-mentioned "permissible" or "suitable" impulse energy is the need to maintain continuity of the actuating resistor. This consideration, however, is not very important if the nozzle is not going to work anyway: whether the operator prefers to discard the pen or operate it with a nonworking nozzle, no harm is done if the unsuccessful priming efforts destroy the resistor in the nonworking nozzle.

As will be appreciated, however, such a procedure can generate a significant amount of heat in a small space. This heat might result in damage to resistors in nearby nozzles.

From these comments it can now be seen what is meant by "permissible or otherwise suitable" and like phrases as used in this document. For any given pen geometry, resistor size and rating, etc., a very modest amount of straightforward trial-and-error experimentation will yield the limits of permissible and suitable priming-impulse energy parameters (voltage, duration, and repetition rate).

Preferred embodiments of the drop-detection system include:

(1) an illumination source DS1 (FIG. 1), (2) an illumination detector CR1 disposed to receive the illumination 9 from the source, (3) an optical path 5 (FIG. 2), between source and detector housings 3 and 4 respectively, that is intersected by an ink-drop path 2 from the nozzle 7' of a TIJ pen 7 (FIGS. 1 and 4), (4) a preamplifier 11 receiving the detector signal, (5) an autotracking negative-pulse detector 15 that receives the preamplifier signal, (6) electronic storage 16 for the resulting signal, and (7) a microprocessor M (FIG. 5) for receiving the signal from storage and applying the signal to control the priming sequence.

The optical source DS1—which has a half-power beam angle of about 20°—is either a visible or preferably a near-infrared light-emitting diode (LED), powered by a current source 12 (FIG. 1) at about 40 mA. This optical source DS1 is feedback-stabilized, with a long time constant, by a transistor Q1 in the electrical-current source 12—to maintain a fixed average signal 21 from the detector CR1, and thereby a substantially fixed average-illumination level.

The current level 23 that energizes the optical source DS1 is set by one platform U1D of a four-section operational-amplifier chip; this section U1D is connected to operate as a differential integrator. The circuit applies a reference voltage 24 of approximately 3 V (from the reference circuit 13) to the positive input terminal of the integrator U1D.

This integrator tends to increase the illumination current 23 until the output 22 of another section U1A of the same amplifier chip—serving as the active element of a preamplifier 11—is equal to the reference voltage 24. For this purpose that preamp section U1A, 11 receives the photocurrent 21 and converts it to a voltage, at a rate of 1 V per 1.18 μA of photocurrent; hence, with the output of the preamp servoed to 3 V, the photocurrent 21 is approximately 3.55 μA.

The bandwidth of this control loop 21-11-12-23 is very low—roughly 740 Hz—and narrow, under control of the time constant R9-C5 at the integrator section U1D. If an ink drop 8 is fired between DS1 and CR1, upon passage of the drop 8 (and accompanying fine spray 5, sometimes called "satellites") through the illumination path, a resulting partial shadow or penumbra (not shown) passes across the detector CR1. Typically only about one part in 1300 of the detector illumination 9 is blocked. This slight decrease in illumination 9 received at the detector CR1 produces a small, very rapid negative-going excursion of the detector signal 22, 35.

Typically this excursion will be seen to somewhat resemble a half-cycle of a sinusoidal waveform of approximately 5 kHz. The preamp 11 amplifies and buffers this signal component for use in a tracking detector 15.

As will be appreciated, the tiny ink-drop-produced pulse is only a small fraction of the already-small 3.55 μA photocurrent, and exists in a typical office or laboratory environment having many sources of electrical as well as optical and microphonic noise. Passage of paper through the printer, for example, or operation of the pen carrier along its guide rails, if either function were permitted during operation of the detector, would create far larger signals—rendering impossible the detection of an ink drop, whose volume is on the order of only 100 picoliters or less.

Accordingly successful practice of the invention requires extreme care in dealing with all these sources of interference. For this important purpose, conventional methods of guarding against noise intrusion into the signal path should be used.

For instance, the drop detector is not operated while the pen is moving, or even while it is exposed in the part of the printer where actual image-printing onto a printing medium occurs. Rather the pen carrier is parked in a partially shielded bay to one side of the paper bed, and preferably all mechanical operations are halted during nozzle monitoring.

The preamp 11 has a current-in-to-voltage-out gain of 0.82 volt per microampere for the d.c. component. To pass the roughly 5 kHz half-wave simulation produced by the ink-drop shadow through the preamp, the RC network R1-C1 in the preamp feedback path rolls off at about 10 to 15 kHz.

The illumination servo 11-22-12-23 tries to null the pulse produced by the ink drop 8; however, the circuit bandwidth is far too narrow and low to follow the rapid excursion just described. It would be very undesirable to be able to see the effect of a single ink drop at the servo output stage Q1, since this would tend to offset the signal developed for measurement, and so would have the effect of discarding some of the very small available ink-drop detection signal.

The main feedback module 12 accordingly functions as a self-adjusting low-bandwidth integrating current source for setting the illumination level. In this way the system is rendered reasonably free of gross variation with temperature, alignment, and age; these are all compensated by the stabilizing output voltage.

The bandwidth of the illumination servo is, however, positioned high enough to reduce the response to the 120 Hz stray light from fluorescent fixtures nearby. Otherwise the signal at the output of this stage would be susceptible to substantial noise caused by such stray light. At the same time the frequency response of the servo helps to attenuate power-frequency pickup.

The voltage output from the feedback-loop amplifier U1D is applied to the base of a transistor Q1 in series with the optical source DS1. A resistor R12 also in series with the transistor Q1 and source DS1 causes the controlled reference voltage at the base of the transistor Q1 to produce the behavior of a controlled current source.

The detector or sensing element CR1 is a silicon photodiode, such as a type commercially available by reference to the component designator "Sharp PD-410", with an integral lens. A phototransistor could be substituted, but in such devices the noise input is larger and rise time longer. The photodiode CR1 operates at zero bias across the differential inputs of the preamplifier section U1A; the photocurrent 21 develops a voltage across the resistor R1 in the preamp feedback loop, and also across an input resistor R2.

After preamplification the ink-drop-generated pulse at the output 22 of the preamp 11 is coupled through a capacitor C3 into the next amplifier module 14 of the circuit. This capacitor C3 provides a. c. coupling so that the amplifier 14 in essence receives only the fast pulse representing presence of an ink drop.

Within the amplifier module 14, two other sections U1B and U1C of the same op-amp amplify the a. c. component of the signal from the preamp section U1A, for passage to the electrical-pulse detector 15. The amplifier 14 provides a gain of approximately 43, with a bandwidth of about 15 kHz, and also two inversions in series, so that the pulse entering the pulse detector 15 is again negative-going.

It will be instructive to digress briefly for description of a system which I employed in an earlier prototype for a pulse detector 15 (FIG. 1), to trap and evaluate the electrical pulse. That prototype included a synchronous detector, with a pair of analog switches that were closed except for a detection interval of approximately 50 μsec.

With one switch closed, a capacitor was charged to the output voltage of the signal-amplifier stage continually. When that switch was opened, because of the large input impedance of the buffer amplifier the voltage on the capacitor would no longer change.

The effects of this were that the buffer-amp output started at zero voltage, and the integrator stage which followed received only the change in signal during the detection interval. This integrator also was controlled by an analog switch, which set the initial condition of the integrator output to zero at the beginning of the detection interval.

The timing sequence of this detector was triggered by the actuating pulse 43, 44 (FIG. 5) directed to the TIJ nozzle. The first fifty to 150 μsec after the actuating pulse allowed for the drop 8 (FIGS. 1 and 4) to reach the light beam 9 of the optical stage 1; this time can vary with the mechanical configuration and the drop velocity, After this flight-delay interval, the detection interval began. During the detection interval both switches were opened and the integrator accumulated the output of the buffer amp—which is the same as the signal-amp output except that the level is shifted to zero at the beginning of the detection interval, so that as noted above the integrator integrates only the change in the signal during the detection interval.

This system worked well, but required two switches and somewhat fussy electrical timing alignment; in view of these undesirable costs I have developed instead the system illustrated. For reliable operation, both systems require ink-drop firing rates that are relatively low—for example, around 1500 drops per second.

In the present system, the signal detector triggers automatically on any signal 25 reaching it that goes at least 300 mV below the average signal level, which is normally 3 V. This tracking negative-pulse detector module 15 thus avoids the necessity for synchronous analog switching.

With 3 V input from the amplifier stage 14, part of the current at the input point 25 is diverted into a voltage divider R7-R8, which produces a level-shifted potential 29, nominally 2.7 V. This level-shifted input 29 drives a low-pass filter R13-C8 that cannot track the drop signals, to develop a tracking threshold 26 for the comparator U2.

Another fraction of the current at the amplifier 14 output 25 bypasses the divider R7-R8 and filter R13-C8 as shown, proceeding directly to the positive input of the level comparator for comparison with the 2.7 V threshold. The comparator output then is applied to a memory element—a flipflop D—setting the flipflop if an ink-drop pulse was found.

A reset signal is passed to the flipflop in appropriate synchronization (as discussed above for the prototype) with the pen-firing signal, and so reaches the flipflop just before the ink-drop pulse (if any). As will be understood, this arrangement has the effect of providing a narrow time window for collection of the ink-drop-derived signal pulse—equivalent to the analog switching used in the prototype but at much lower cost.

The result is a logic signal, held in a result-latch module 16, which is read by a microprocessor M ( FIG. 5 ) for interpretation as a "drop present" or "drop not present" signal 41 and for generation of further sequencing accordingly, as mentioned earlier. This logic signal 41—correlated by the microprocessor with information that a drop firing was attempted—determines the status of each nozzle 7' in each pen 7.

Representative values of the elements in the drop-detector circuit are:

| | | | |
|---|---|---|---|
| R1 | 422 kΩ | R9 | 2.15 kΩ |
| R2 | 422 kΩ | R10 | 6.19 kΩ |
| R3 | 10.0 kΩ | R11 | 2.15 kΩ |
| R4 | 215 kΩ | R12 | 108Ω |
| R5 | 10.0 kΩ | R13 | 100 kΩ |
| R6 | 215 kΩ | R14 | 100 kΩ |
| R7 | 1.47 kΩ | R15 | 1.0 kΩ |
| R8 | 10 kΩ | | |
| C1 | 30 pF | C5 | 0.1 μF |
| C2 | 30 pF | C6 | 47 pF |
| C3 | 0.1 μF | C7 | 0.1 μF |
| C4 | 47 pF | C8 | 0.1 μF |
| U1 | LM324 | U2 | LM311 |
| Q1 | 2N3904 | D | 74ALS74NG. |

Figure 3:
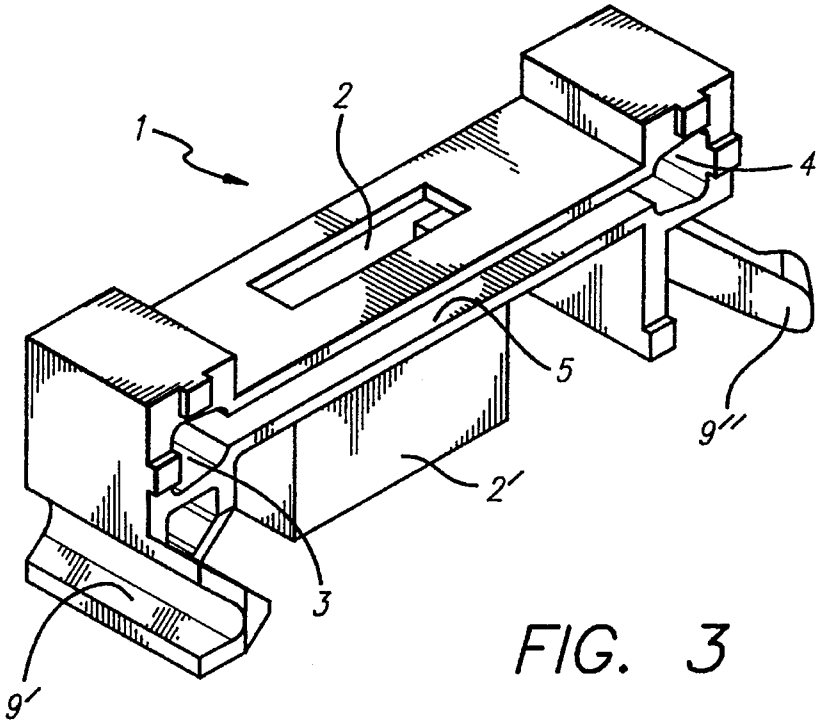
FIG. 3 is a left-side perspective view of the FIG. 2 chamber.
Figure 2:
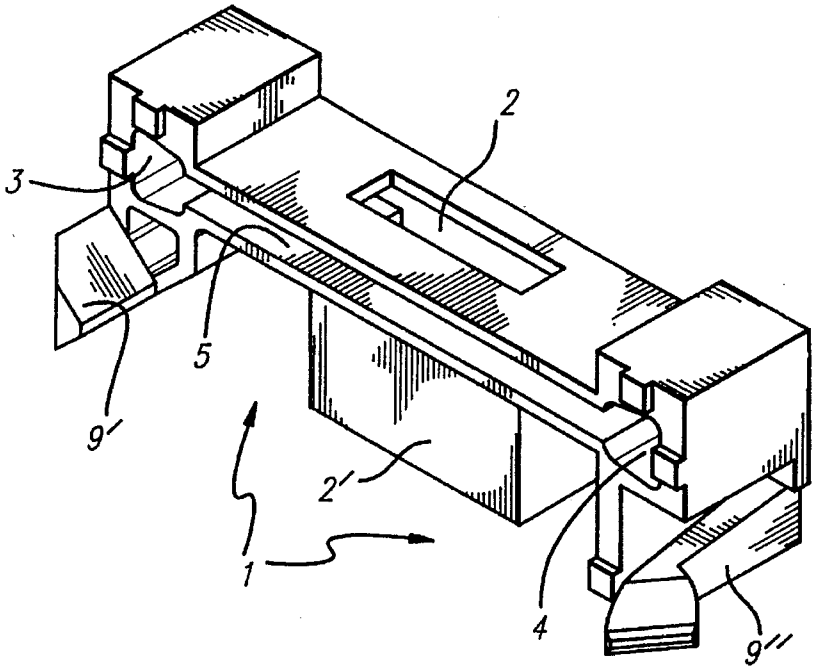
FIG. 2 is a right-side perspective view of an ink-drop sensing chamber according to preferred embodiments of the invention.
Figure 4:
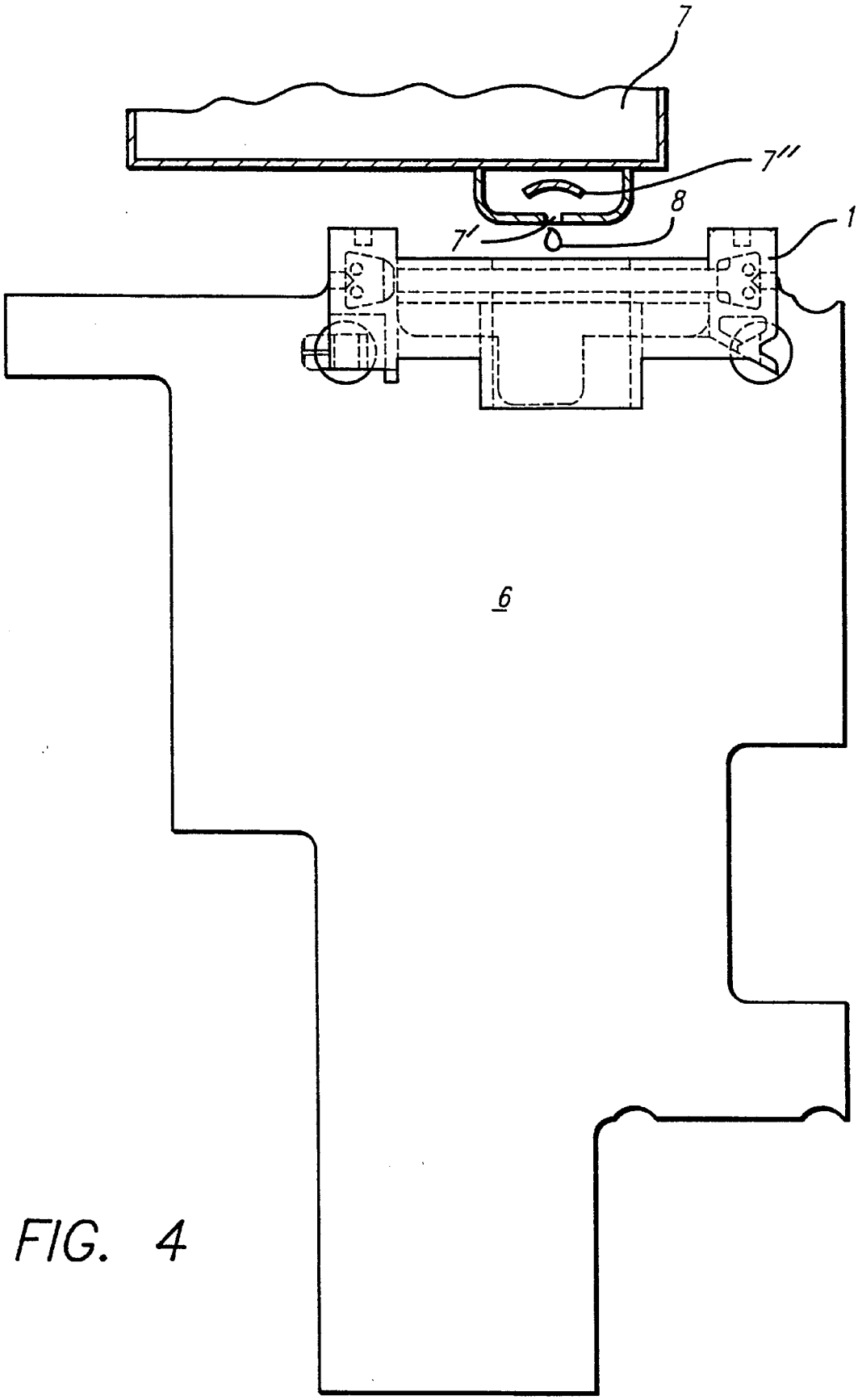
FIG. 4 is a generally schematic elevation, partially in cross-section, showing the FIG. 2 chamber in conjunction with a printed-circuit board carrying the FIG. 1 circuit and also in conjunction with a TIJ pen and nozzle.

FIGS. 2 through 4 show the mechanical/optical system used for sensing drops of ink. As mentioned above, the sensor chamber 1—which is open, not sealed—is positioned to one side of the paper bed, where the pen can be parked during nozzle testing, priming etc.

The optical source DS1 (FIG. 1) fits into a pocket or housing 3 (FIGS. 2 and 3) at one end of the sensor chamber 1, and the detector CR1 (FIG. 1) fits into a like pocket or housing 4 at the other end of the chamber 1. A light channel 5 between the two optical-element pockets 3, 4 serves as optical path—roughly 3 cm long.

Intersecting this path at right angles is a channel 2, approximately 4 mm wide and 15 mm long, for passage of ink drops through the light beam and through a chute 2' into an evaporation sump (not pictured) below the chute. A mounting rail 9' and detent 9" enable easy attachment of the chamber 1 to the printed-circuit board 6; the board 6 slides into a mating slot provided in the printer, and is easily removed for replacement if needed.

When so installed the sensor chamber 1 is oriented with the channel 2 vertical. That is, ink drops 8 (FIG. 4) from a pen 7 can be fired vertically through the channel 2 and chute 2' into the sump.

As FIG. 4 also indicates diagrammatically, the pen 7 carries a representative nozzle, with its nozzle orifice 7' and thin-film actuating resistor 7". Of course as is well known each pen 7 carries a multiplicity of such nozzles 7', each independently controllable through its own respective resistor 7".

The circuit of FIG. 1 resides with other electronics on a printed-circuit board 6. Preferably, to help minimize electrical interference, the sensor circuit is immediately adjacent to the sensor chamber 1 as shown.

The optical beam through the channel 2 is broad enough to permit evaluation of any nozzle 7' on the pen 7 by selection of the nozzle to be fired, without moving the pen 7 from its parked position. All nozzles 7' can be tested during operation (in a broad sense) of the printer—i.e., between plots with a printer/plotter, or between pages or groups of pages with a text printer.

Figure 5:
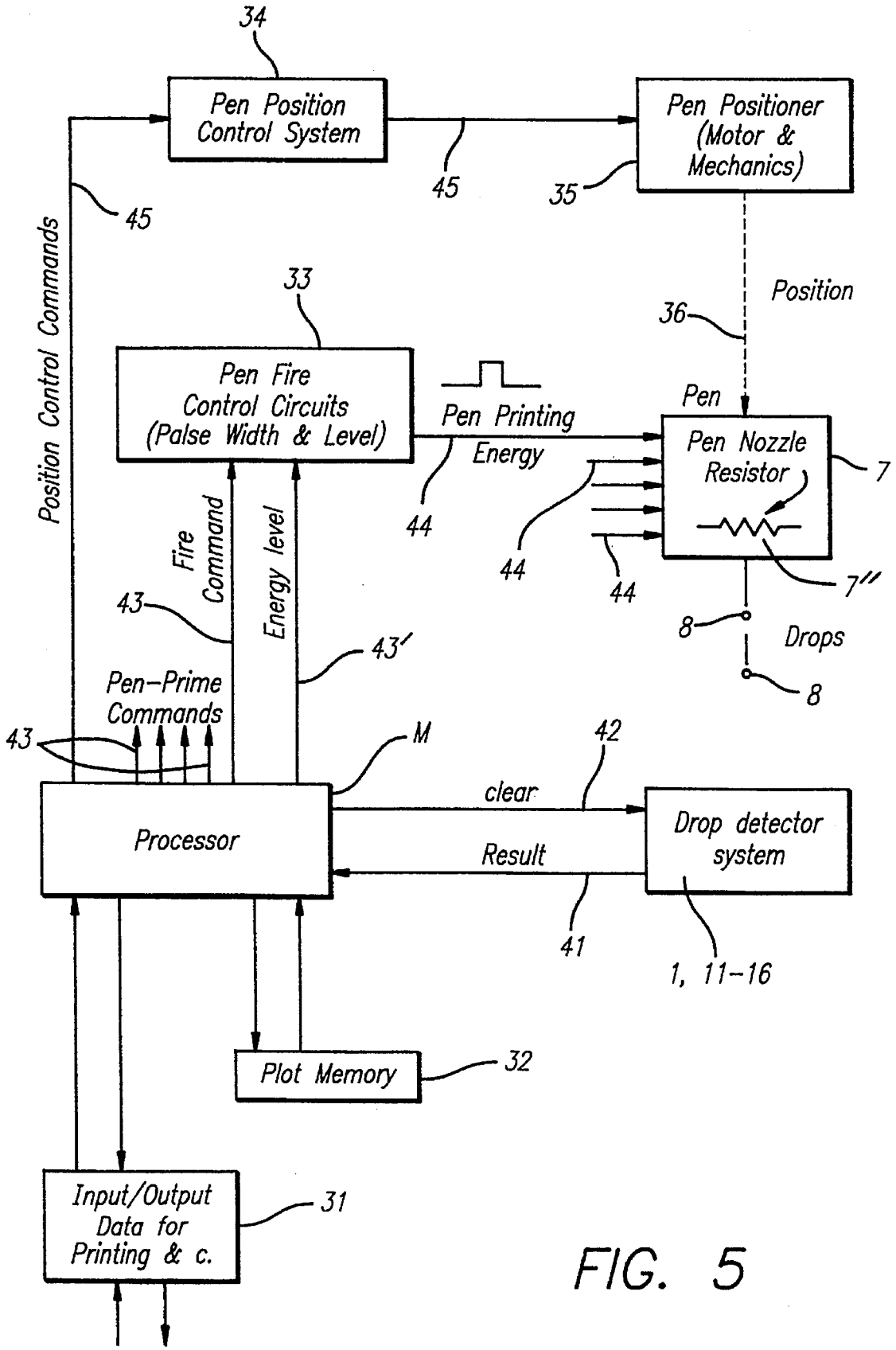
FIG. 5 is a block-diagrammatic showing of the FIG. 1 through 4 elements incorporated into a printer—including a highly schematic representation of a typical TIJ pen, and a nozzle thereof with its actuating resistor.

Relationships between the sensor chamber 1, with its electronics 11–16, and the other elements of the printer system appear in FIG. 5. The microprocessor M mentioned above is present in any event, being used to receive data 31 for printing and to control temporary storage 32 and a pen-positioning system 34–36 as well as direct operation of the pen control circuits 33 to perform the actual printing process.

Necessary command connections 43, 44 too, from the microprocessor M to the pen-drive circuits 33 and thence to the individual nozzles, are already present—for each nozzle independently—in a printer as a part of the general operating or writing system of the printer. Therefore they need not be specially provided as a part of the detection-and-feedback system of the invention or for use in pen-priming efforts.

It is helpful to recognize the distinction between pen-actuating signals for purposes of testing ink flow (or for purposes of actually creating a document) and pen-actuating signals for the purpose of correcting inadequate ink flow. The objective of the present invention is to determine whether each nozzle can be made to operate correctly in response to pen-actuating pulses of rated or nominal energy (i.e., voltage and duration).

Therefore tests preferably are conducted with test pulses of that energy. If the tests indicate ink-flow failure, however, the system applies to the pen priming pulses of progressively higher energy as already described.

For purposes of illustration the connections used for both types of pulses (and normal writing pulses as well) are symbolized in FIG. 5 as separate wires 43, 44. More typically, however, some or all the connections may be provided in the form of a common data bus from the microprocessor to (at least) each pen-drive circuit.

Figure 6:
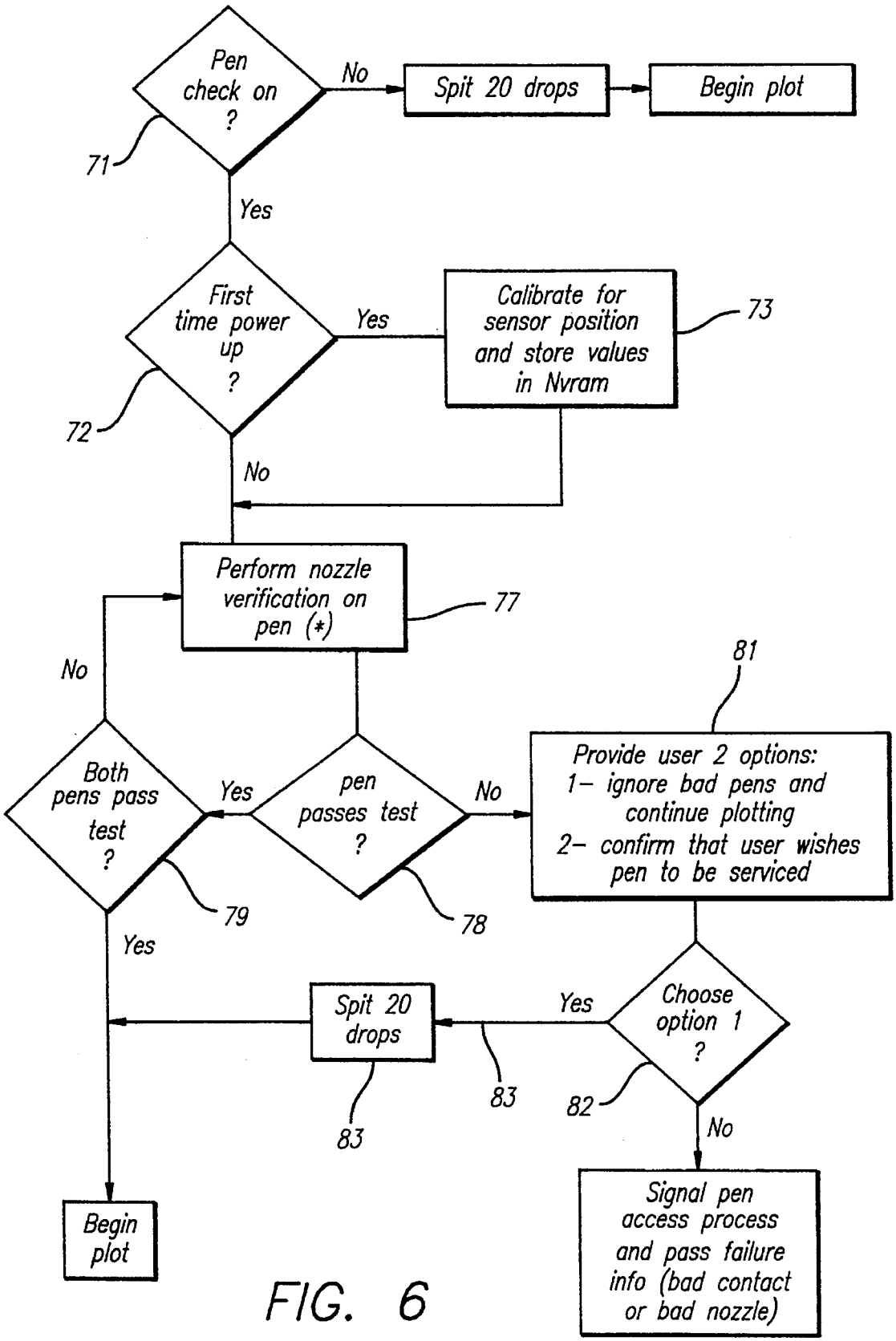
FIG. 6 through 8 are software flow charts showing operational sequencing to check the pen(s), to prime or reprime a pen nozzle, and possible suspension of printing for ink resupply etc. More particularly.
Figure 7:
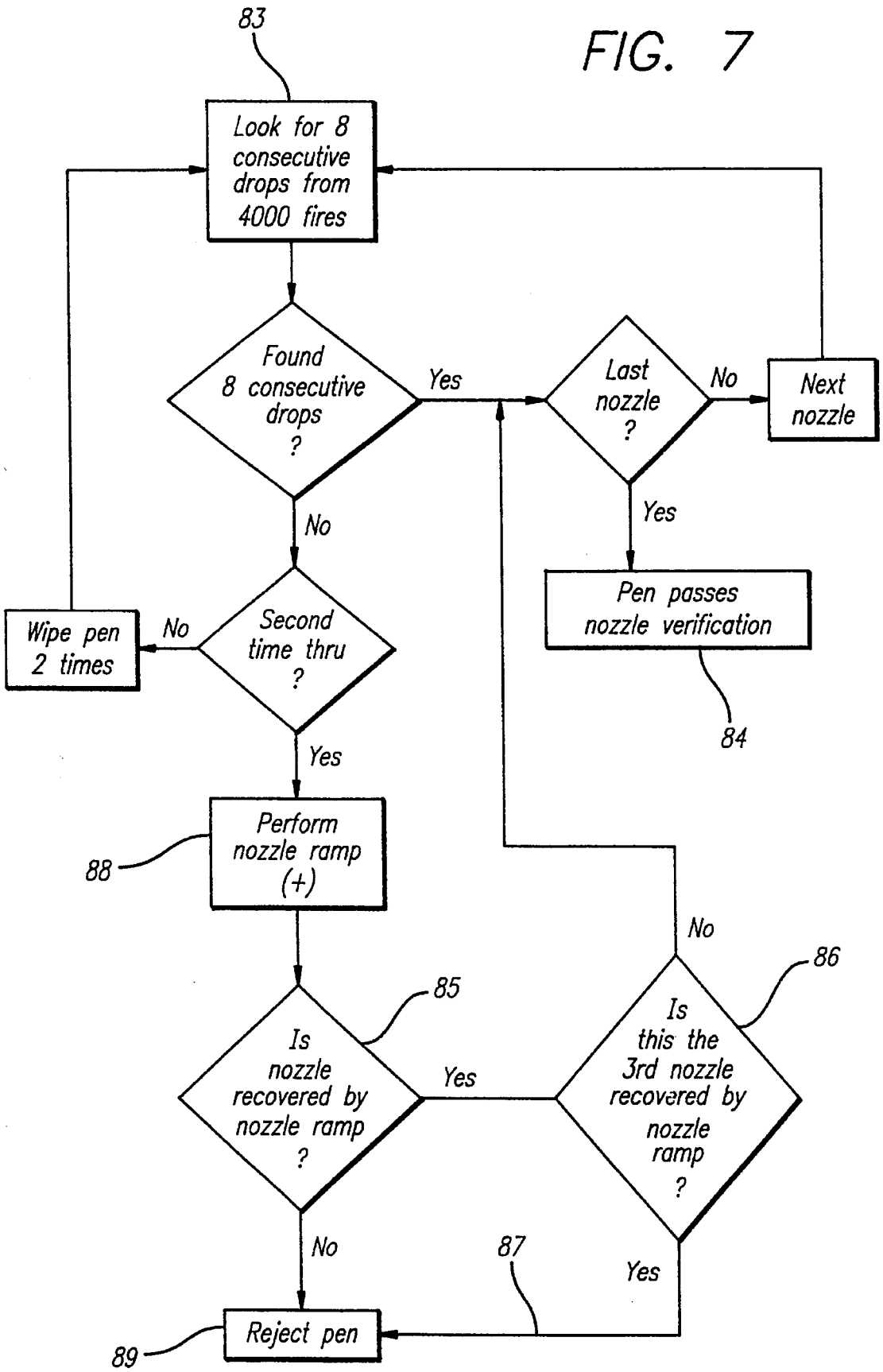
Figure 8:
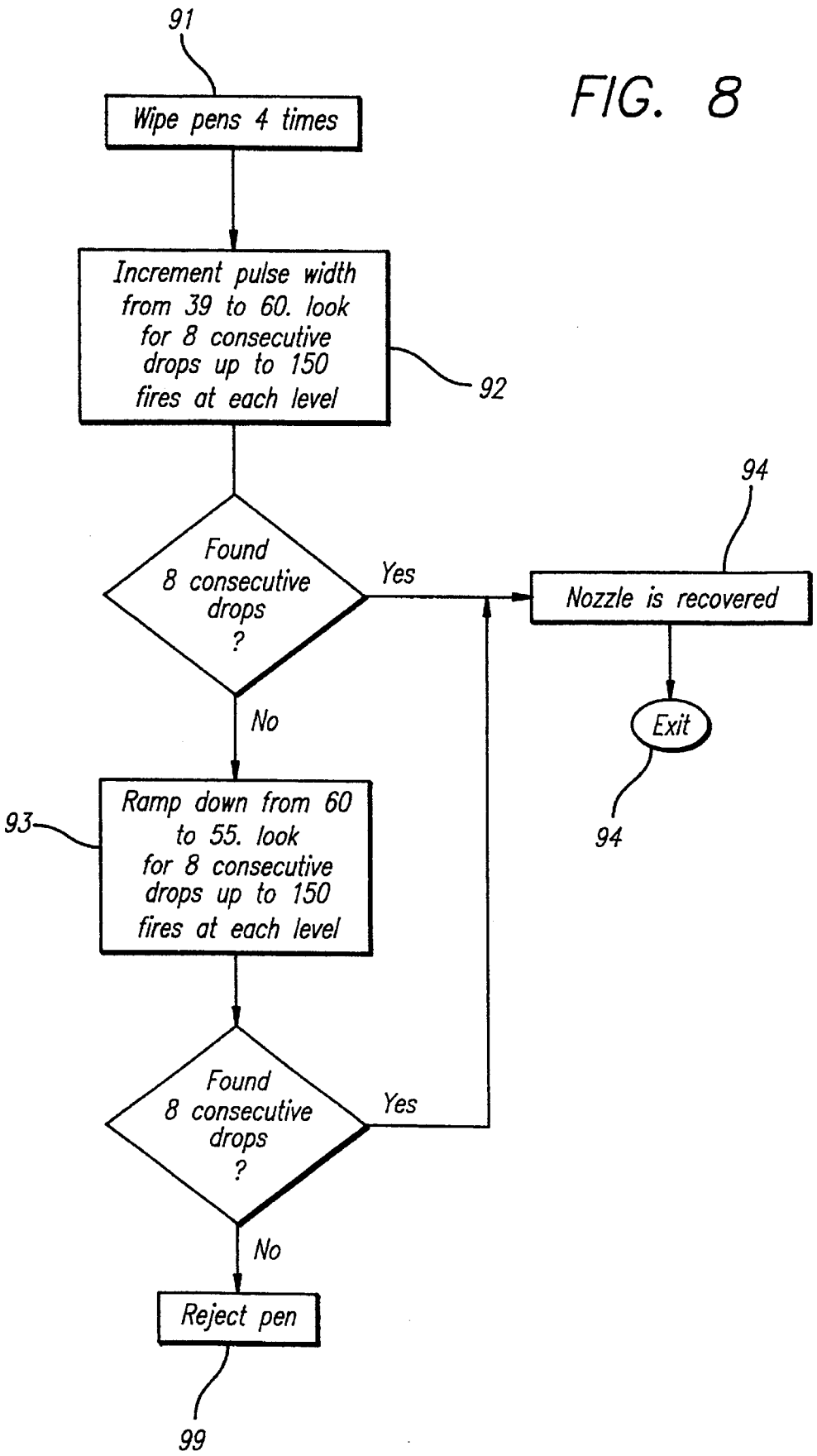

FIGS. 6 through 8 represent the sequencing produced by the microprocessor in response to the logic signal from the flipflop D. In view of the above-presented descriptions of operation, these flow charts will be self explanatory to those skilled in the art.

It may be noted, however, that in FIG. 6 the "Pen check on?" block 71 is entered after "power up"—in other words, each time the printer is switched on. Alternatively if desired it may also be entered before the beginning of each plot. As the drawing makes clear, the user may elect to bypass the entire pen-check procedure if, for example, the user wishes to make a series of test or other preliminary plots in which pen quality is unimportant—or in which the user may actually prefer to use a partially inoperative pen to avoid wasting ink in a good pen.

Pen performance is sensitive to the position of the drop-test sensor CR1 (FIG. 1). Hence a calibration protocol that memorizes an array of position-sensitive factors is included at block 73, which is called at block 72 in the first power-up sequence for each printer; if desired this may be repeated whenever the sensor is replaced.

Merely for definiteness the FIG. 6 system, as will be evident upon study of the drawing and particularly the loop comprising blocks 77 through 79, is specific to systems having two pens. Generalization to systems with other numbers of pens will be plain to those skilled in the art.

Advantageously the user is given an opportunity to override a finding of one or more bad pens in the system, as represented in FIG. 6 by the path 81 through 83. The rationale for this provision is parallel to that discussed above with respect to block 71.

In performing nozzle verification 77 (FIG. 6), the system enters the FIG. 7 detailed procedure by determining at block 83 whether a particular nozzle faithfully emits eight consecutive drops, within a rapid sequence of 4,000 energizations—and does so twice in succession. Depending upon the performance of all the nozzles in each pen, the system leaves the procedure either with approval of the pen performance at block 84, or with rejection of a pen at block 89.

As indicated at the nozzle-recovery evaluation path 85–86–87 in FIG. 7, it is considered preferable to reject a pen even if nozzles can be made to recover from bad performance— if too many of the nozzles require this special accommodation. In our experience, if some three or more nozzles in a pen will work only after the nozzle-ramp procedure, then troublesome performance of that pen in actual operation is sufficiently likely to justify abandoning 87–89 the pen in favor of one whose operation seems less temperamental.

The nozzle-ramp procedure 88 of FIG. 7 appears in detail as the algorithm of FIG. 8. The system enters this latter procedure by preparation 91 of the pens for test by cleaning away excess ink; and exits either with successful recovery 94 of one nozzle, or with failure 99 of one nozzle to recover.

The "ramp" procedure itself is so-named because of a pair of progressively operating minor loops 92, 93 shown simply as blocks in FIG. 8. The general strategy for block 92 is to apply a series of successively more energetic firing stimuli to the nozzle (up to an energy level considered the maximum safe one), and determine at each energy level whether the nozzle has responded.

Curiously, sometimes even when this procedure fails to revive operation of a nozzle we find that nevertheless may be possible through slightly lowering the energy and trying again. This last-chance effort to rescue a nozzle is the rationale behind the downramp block 93.

The pulse-width values "39", "55" and "60" appearing in the drawing are specific to the equipment identified above as our preferred embodiment, and for those skilled in the art will be illustrative for purposes of other apparatus. Each "pulse" is approximately 0.083 μsec; thus the pulse widths are respectively about 3.2 μsec for "39" pulse-width units, 4.6 μsec for "55", and 5 μsec for "60".

The invention as now embodied does have certain limitations. As noted above, a desirable ink-drop repetition rate which allows enough time for operation of the synchronous detector—for purposes of discrimination between response to different actuating impulses—is only about 1½ kHz. This rate is much lower than the 3 to 5 kHz that may obtain in full-speed printing.

As the ink supply in a pen nears exhaustion, and under some other circumstances (e.g., partial viscous plugging), ink may flow adequately at the lower speed but not the higher ones. Various procedures may be brought to bear in an effort to overcome this limitation.

For example, the pen might be commanded to produce a rapid stream of drops to simulate high-speed operation in regard to the capillary hydrodynamics of ink flow within the pen—but without any attempt to monitor those drops using the drop-detector system. Then a drop-detection sequence might be initiated immediately thereafter, while any inadequate-flow condition persists. This system might be described as a drain-and-then-test technique.

As another example, the system can command the pen to produce a very rapid stream of drops—fast enough to actually change the average illumination at the drop detector photodiode CR1. This has the effect of drawing down the operating level of the feedback control system, which attempts to restore the nominal average.

Under these special circumstances the voltage or current level in the feedback system, or preferably the linearly related excitation 28 provided to the LED DS1, can be monitored simultaneously through an analog-to-digital converter (not shown) as a measure of the ink flow rate. (In my present system the level 28 is passed to the main board of the instrument, for use as a diagnostic signal showing the status of the servo loop 11-22-12-23.) If there is no drawup of the operating level to compensate for the optical obscuration by the rapid ink flow, the pen is malfunctioning or empty.

Both these exemplary methods, in turn, suffer from a common limitation: they consume a large quantity of ink. That is, it may be objected that the detection system is wasting ink.

This difficulty may be mitigated by instituting such testing only toward the end of the predicted life of the pen—as, for example, after perhaps eighty or eighty-five percent of the rated number of ink drops for the pen. Such information is available within the system.

Under such conditions, it may be preferred to use some ink to thereby avoid wasting paper and printing time; further, this technique could be made an operator-selected option. Ink consumption aside, I have successfully operated the voltage-drawdown method—but not the drain-and-then-test method. I have not put into operation any pen-life-dependent testing regimen.

Another feature of the system is provision for simulating a drop electronically to test the operation of the detector. If the LED light output is decreased during the detection interval by an amount similar to the amount of decrease caused by an ink-drop shadow, and if the system is working correctly, the detector circuit should respond in a similar manner.

That is to say, at the end of the detection interval the system should indicate presence of a drop. To decrease the LED illumination output for this purpose, the LED current is decreased slightly—roughly one percent—by closing an analog switch S1 during the detection interval.

It will be understood that the foregoing disclosure is intended to be merely exemplary, and not to limit the scope of the invention—which is to be determined by reference to the appended claims.

I claim:

1. A procedure for controlling the priming and use of a thermal-inkjet pen in a printing machine used for creation of documents, said printing machine having means for controlling the priming and use of the pen in response to an applied signal; said procedure comprising the steps of:

directing to the pen a priming impulse of nominally suitable energy;

detecting a discharge of ink from the pen, said detecting step including generating at least one signal that is characteristic of said discharge; and automatically applying said at least one signal to the priming-and-use controlling means to operate the priming-and-use controlling means;

wherein said detecting step comprises, in a generally synchronized relationship with said impulse-directing step, defining said at least one signal;

wherein said automatically-applying step comprises the substeps of (1) determining whether said at least one signal indicates inadequate discharge of ink from the pen and, if so, then (2) automatically directing a more-energetic priming impulse to the pen;

also if so, then further comprising automatically repeating said detecting step, but with respect to said more-energetic priming impulse of said directing substep (2);

but if not, then automatically refraining from directing a more-energetic priming impulse to the pen, and automatically refraining from repeating said detecting step; and wherein selection between said directing substep (2) and said refraining step is automatic and is based on said determining substep (1), with no preestablished schedule of priming-impulse energy versus time.

2. A procedure for controlling the priming and use of a thermal-ink jet pen in a printing machine used for creation of documents, said printing machine having means for controlling the priming and use of the pen in response to an applied signal; said procedure comprising the steps of:

directing to the pen a priming impulse of nominally suitable energy;

detecting a discharge of ink from the pen, said detecting step including generating at least one signal that is characteristic of said discharge; and applying said at least one signal to the priming-and-use controlling means to operate the priming-and-use controlling means;

wherein said detecting step comprises, in a generally in synchronized relationship with said impulse-directing step, defining said at least one signal;

wherein said applying step comprises the substeps of (1) determining whether said at least one signal indicates inadequate discharge of ink from the pen and, if so, then (2) automatically directing a more-energetic priming impulse to the pen;

also if so, then further comprising repeating said detecting step, but with respect to said more-energetic priming impulse of said directing substep (2);

also if so, then iterating said applying and repeating steps in alternation, as a pair, with progressively more-energetic priming impulses in said directing substep (2), until either said at least one signal indicates adequate discharge of ink from the pen or a priming impulse of maximum suitable energy has been applied;

but if not, then automatically refraining from directing a more-energetic priming impulse, and refraining from repeating said detecting step, and refraining from iterating any detecting and repeating steps; and wherein selection between said directing substep (2) and said refraining step is automatic and is based exclusively on said determining step (1), with no preestablished schedule of priming -impulse energy versus time.

3. The procedure of claim 2, further comprising:

if a priming impulse of maximum suitable energy has been applied, also suspending creation of documents pending ink resupply.

4. The procedure of claim 2, further comprising:

if a priming impulse of maximum suitable energy has been applied, also suspending creation of documents pending either:

ink resupply, or an operator's command to proceed despite inadequate ink discharge.

5. The procedure of claim 1, wherein:

said directing step comprises transmitting to the pen an electrical pulse of a particular voltage and duration; and said directing substep (2) of said applying step comprises transmitting to the pen an electrical pulse having a higher voltage, or having longer duration, or having some combination of higher voltage and longer duration.

6. A procedure for controlling the priming and use of a thermal-inkjet pen in a printing machine that is used in normal operation for creation of documents, said normal operation comprising a direction of actuating impulses to the pen at a normal-operation repetition rate, and said printing machine having means for controlling the priming and use of the pen in response to an applied signal; said procedure comprising the steps of:

detecting a discharge of ink from the pen in response to actuating impulses having a repetition rate lower than said normal-operation repetition rate, said detecting step including generating at least one signal that is characteristic of said discharge;

directing pen-actuating impulses to the pen at a rapid repetition rate substantially corresponding to said normal operation repetition rate, to simulate effects of normal operating conditions, substantially concurrently with but before said detecting step; and applying said at least one signal to the priming and use controlling means to control the priming-and-use of the pen.

7. A procedure for controlling the priming and use of a thermal-inkjet pen in a printing machine used for creation of documents, said printing machine having means for controlling the priming and use of the pen in response to an applied signal; said procedure comprising the steps of:

detecting a discharge of ink from the pen, said detecting step including generating at least one signal that is characteristic of said discharge;

directing pen-actuating impulses to the pen at a rapid repetition rate to simulate normal operating conditions, substantially concurrently with said detecting step; and applying said at least one signal to the priming-and-use controlling means to operate the priming-and-use controlling means; and wherein:

the detecting step comprises stabilizing an optical source by applying electrical feedback in a long-time-constant stabilization circuit to substantially stabilize long-term illumination at an optical detector, and using optical response to the discharged ink at said detector to define said at least one signal;

the actuating-impulse-directing step employs a rate that is sufficiently rapid to produce a protracted optical response to the discharged ink, drawing down an operating level of said stabilization circuit; and the detecting step further comprises monitoring the operating level of said stabilization circuit substantially concurrently with the actuating-impulse-directing step;

whereby a drawdown of said operating level as monitored represents a further signal that is characteristic of said discharge, under said simulated operating conditions.

8. A procedure for controlling the priming and use of a thermal-inkjet pen in a printing machine used for creation of documents; said procedure comprising the steps of:

directing to the pen a priming impulse of nominally suitable energy to attempt to produce a discharge of ink from the pen;

in a generally synchronized relationship with said impulse, generating at least one signal that is characteristic of presence, absence and adequacy of said discharge; and determining whether said at least one signal indicates inadequate discharge of ink from the pen and, if so, the substep of automatically applying a more-energetic priming impulse to the pen; and automatically repeating said generating step, but with respect to said more-energetic priming impulse.

9. A procedure for controlling the priming and use of a thermal-inkjet pen in a printing machine used for creation of documents; said procedure comprising the steps of:

directing to the pen a priming impulse of nominally suitable energy to attempt to produce a discharge of ink from the pen;

in a generally synchronized relationship with said impulse, generating at least one signal that is characteristic of presence, absence and adequacy of said discharge; and determining whether said at least one signal indicates inadequate discharge of ink from the pen and, if so, the substep of applying a more-energetic priming impulse to the pen;

repeating said generating step, but with respect to said more-energetic priming impulse; and iterating said determining-and-applying step, and said repeating step in alternation, as a pair, with progressively more-energetic priming impulses in said directing substep, until either said at least one signal indicates adequate discharge of ink from the pen or a priming impulse of maximum suitable energy has been applied.

10. The procedure of claim 9, further comprising:

if a priming impulse of maximum suitable energy has been applied, also suspending creation of documents pending ink resupply.

11. The procedure of claim 9, further comprising:

if a priming impulse of maximum suitable energy has been applied, also suspending creation of documents pending either:

ink resupply, or an operator's command to proceed despite inadequate ink discharge.

12. The procedure of claim 8, wherein:

said directing step comprises transmitting to the pen an electrical pulse of a particular voltage and duration; and said applying substep of said determining-and-applying step comprises transmitting to the pen an electrical pulse having a higher voltage, or having longer duration, or having some combination of higher voltage and longer duration.

* * * * *